US005344135A

United States Patent [19]

Isobe et al.

[11] Patent Number: 5,344,135

[45] Date of Patent: Sep. 6, 1994

[54] CURRENCY STACKER RESISTIBLE AGAINST UNAUTHORIZED EXTRACTION OF CURRENCY THEREFROM

[75] Inventors: Atsushi Isobe; Taichi Sato; Takayuki Takeda; Katutoshi Ookawa, all of Sagamihara, Japan

[73] Assignee: Japan Cash Machine Co., Ltd., Osaka, Japan

[21] Appl. No.: 993,604

[22] Filed: Dec. 21, 1992

[51] Int. Cl.[5] ..... B65H 29/38

[52] U.S. Cl. ..... 271/180

[58] Field of Search ..... 271/177, 180, 181, 215, 271/220

[56] References Cited

U.S. PATENT DOCUMENTS

| | | | |
|---|---|---|---|
| 3,977,669 | 8/1976 | Douno | 271/180 |
| 4,050,562 | 9/1977 | Schwippert et al. . | |
| 4,628,194 | 12/1986 | Dobbins et al. . | |
| 4,678,072 | 7/1987 | Kobayashi et al. | 271/181 X |
| 4,722,519 | 2/1988 | Zouzoulas | 271/181 |

FOREIGN PATENT DOCUMENTS

| | | | |
|---|---|---|---|
| 63-208440 | 8/1988 | Japan | 271/180 |

*Primary Examiner*—David H. Bollinger

*Attorney, Agent, or Firm*—Bachman & LaPointe

[57] ABSTRACT

A currency stacker is disclosed which a pusher is positioned within a first chamber of a casing. This pusher comprises a base plate, a pusher plate and a link connecting the base plate and pusher plate for traveling the pusher plate from the retracted position within the first chamber to the extended position in a second chamber of the casing toward and away from the base plate. A bill supplied to the first chamber through a slit of the casing is moved by the pusher plate to the second chamber when the pusher plate is moved to the extended position. Disposed within the first chamber is a driver for operating the link to travel the pusher plate between the retracted and extended positions. The driver keeps the pusher in the extended position to prevent unauthorized removal of the bill from the second chamber.

8 Claims, 7 Drawing Sheets

CURRENCY STACKER RESISTIBLE AGAINST UNAUTHORIZED EXTRACTION OF CURRENCY THEREFROM

BACKGROUND OF THE INVENTION

1. Field of the Invention

The present invention relates, in general, to bill handling, and in particular to the improvement of currency stacker for preventing unauthorized extraction of currency from the stacker which may contain a plurality of currency.

2. Description of the Prior Art

Current bill handling apparatuses include money exchanging or vending machines each provided with a bill validator for identifying the authenticity or denomination of a bill or paper currency inserted therein. When inserted into an inlet of the validator, the bill is conveyed by a belt-pulley arrangement through a sensor which detects optical or magnetic characteristics of the bill. After the bill validator identifies the insertion with a genuine bill from outputs of the sensor, it is then transported to a stacker wherein bills are accumulated for storage while exchanged bills, coins or goods are put out in a tray of the machine. Adversely, if the bill validator can not decide the insertion as a genuine bill, the belt-pulley arrangement is driven in the reverse direction to return the insertion to the inlet. For instance, U.S. Pat. No. 4,628,194 to Bob M. Dobbins, et al. indicates a prior art validator and U.S. Pat. No. 4,722,519 to John Zouzoulas shows a stacker apparatus.

In some cases, a string-like material such as a thread or tape is intentionally attached to one end of a bill which is then inserted into the inlet of the validator. The bill is transported along a passageway in the bill validator by the belt-pulley arrangement through the sensor to the stacker or an escrow compartment as shown in U.S. Pat. No. 4,050,562 to G. A. Schwippert, and an exchange is thrown out on the tray of the apparatus. After that, the bill is pulled back from the apparatus by pulling the string. Many attempts have been made in the past for preventing unauthorized removal of a bill contained within the stacker. However, there have not been proposed any good structure of currency stackers to fully prevent such unauthorized removal of the bill. Also, in case that a stacker together with accumulated bills therein must be transported to a predetermined position, it is very easy for a person to extract bills from prior art stackers since they do not have the structure resistible to unauthorized access thereto.

SUMMARY OF THE INVENTION

Accordingly, it is an object of the present invention to provide a currency stacker for effectively preventing unauthorized removal of a bill from the stacker.

It is another object of the present invention to provide a currency stacker which comprises pusher means resistible to unauthorized extraction of a bill from the stacker.

Still another object of the present invention is to provide a currency stacker for preventing improper removal of a bill therefrom with a pusher plate normally retained in the extended position.

A further object of the invention is to provide a currency stacker with pusher means which may detachably be brought into driving connection with conveyer means.

According to the present invention, the currency stacker of the present invention comprises a metallic casing for defining first and second chambers and a slit through which a bill is supplied to the first chamber; and pusher means positioned within the first chamber of the casing. The casing comprises a pair of stoppers for defining the first and second chambers and for supporting a bill within the first chamber and includes a coverage for shielding an end of the casing; and look means for locking or unlocking the coverage in the casing.

The pusher means comprises a base plate; a pusher plate and link means connecting the base plate and pusher plate for traveling the pusher plate from the retracted position within the first chamber to the extended position in the second chamber toward and away from the base plate. The pusher plate may transport the bill from the first chamber to the second chamber when the pusher plate is moved to the extended position. Disposed within the first chamber is driving means for operating the link means to travel the pusher plate between the retracted and extended positions. The driving means maintains the pusher means in the extended position to prevent movement of a bill from the second to the first chamber except when the bill is supplied through the slit into the first chamber.

The driving means comprises a wire connected to the link means; a pulley rotatably mounted on a drive shaft; a gear mounted on the drive shaft for transmitting driving force to the drive shaft; and a spring for resiliently urging the pusher plate. Upon rotation of the drive shaft, the pulley pulls via the wire the link means against elastic force of the spring to cause the pusher plate to move to the extended position. The gear of the driving means is in driving connection with conveyer means for causing the pusher means to push a bill in the first chamber into the second chamber. The driving means has a gear which may be brought into engagement with a drive or planet gear rotatably attached to a frame member. The driving means comprises an one way clutch provided in the pulley to drivingly connect the drive shaft and pulley in only one rotational direction. The one way clutch is released when the motor is rotated in the forward direction.

The link means comprises a pair of guide links and pusher links, both of which are connected between the base plate and pusher plate. The guide links are in hinged connection by an axis into X shape. The pusher links are pivotally connected to each other by a pin. The pusher plate is retained in the extended position after the bill is pushed into the second chamber until a motor is rotated in the forward direction. The pusher plate is moved from the extended position to the retracted position by elastic force of the spring when the motor is rotated in the forward direction.

Positioned within the second chamber of the casing is retaining means which comprises a back plate for supporting a bill supplied from the first chamber by the pusher means; and at least a spring for resiliently urging the back plate toward the stoppers provided at the casing in an intermediate portion between the first and second chambers.

A first shaft is connected to one end of one of the guide links and is received within an elongated hole of the base plate. A second shaft is connected to one end of the other of the guide links and received within an elongated hole of the pusher plate to move the pusher plate in parallel relation to the base plate.

In operation, when a bill is inserted into the inlet, the validator detects predetermined optical or magnetic characteristics of the bill and decides the bill as genuine, and subsequently the bill is conveyed through the conveyer means toward the stacker. When the validator can not decide the bill as genuine, the bill is returned to the inlet by reverse rotation of the belt-pulley arrangement.

When the bill reaches the conveyer means, the motor is driven to operate the endless belt and the bill is moved along the guide member of the conveyer means to the stacker during which the pulley of the stacker means is not rotated by virtue of the one way clutch. The bill is conveyed from the conveyer means within the first chamber of the stacker through the slit of the casing, and is placed on the stoppers positioned between the first and second chambers. When the bill is positioned on the stoppers, the motor is reversely rotated, and thereby the pulley is rotated by the motor via the one way clutch to pull the wire so that the link means is operated to move the pusher plate from the retracted position within the first chamber to the extended position in the second chamber. Accordingly, the bill is also moved to the second chamber together with the pusher plate and back plate against elastic force of the spring positioned within the second chamber. When the pusher plate is fully moved to the extended position, activation of the motor is stopped and the pusher plate is maintained in the extended position until the motor is again rotated in the forward direction.

Assuming that a string material is attached to an authentic bill which is then inserted into the inlet of the passageway, it is conveyed to the stacker. When the bill is drawn back from the stacker by pulling the string material, the pusher plate completely hinders withdrawal of the bill because the link means firmly retain the pusher plate in the extended position due to friction force of the driving system. After that, when a next genuine bill is inserted into the inlet and the motor is rotated in the forward direction, the one way clutch is released. Accordingly, resilient force of the spring causes to move the pusher plate from the extended position to the retracted position. Lock means effectively prevents unauthorized opening of the coverage of the casing.

BRIEF DESCRIPTION OF THE DRAWINGS

The features and advantages of the present invention will be clearly understood with reference to the accompanying drawings. FIGS. 1–7 illustrate a best embodiment of the apparatus for currency validation according to the present invention, wherein:

FIG. 1 is a cross section of a currency handling apparatus which includes stacker means according to the present invention;

FIG. 2 is a perspective partial view of conveyer means equipped in the currency handling apparatus of FIG. 1;

FIG. 3 illustrates a section view of the stacker means of the present invention taken along a longitudinal central line;

FIG. 4 is a section view of the stacker means of the present invention taken along a transverse central line;

FIG. 5 shows an enlarged side view of the pusher means positioned within the stacker means of FIG. 3.

FIG. 6 is a perspective partial view showing interior of a casing of the stacker means; and FIG. 7 is a perspective partial view showing a gear within the casing of the stacker means.

DETAILED DESCRIPTION OF THE INVENTION

Figure 1:
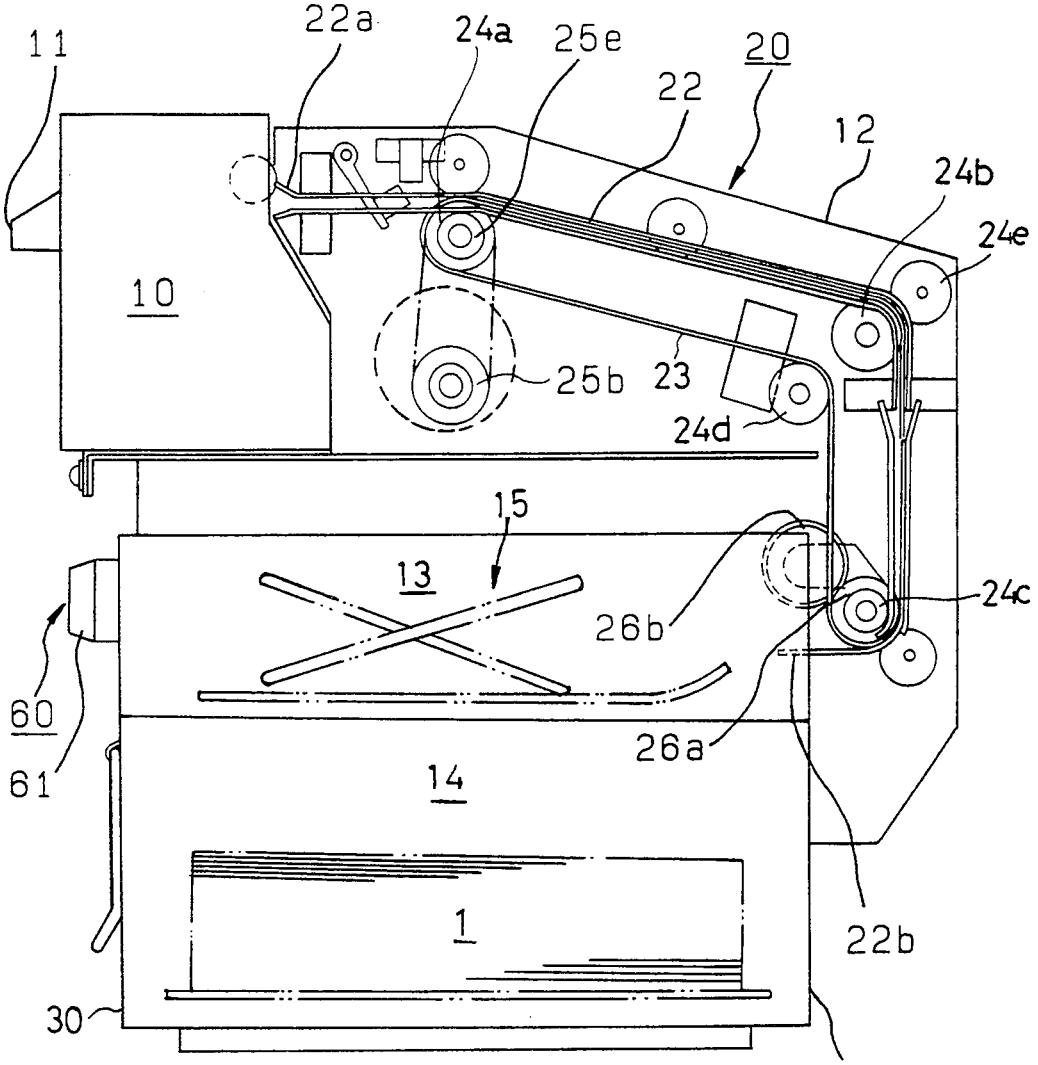

As apparent from FIG. 1, a bill handling apparatus comprises validator means 10 for identifying authenticity of a bill, stacker means 30 for storing bills and conveyer means 20 for traveling the bill from the validator means 10 to the stacker means 30. These validator means 10, conveyer means 20 and stacker means 30 are mounted on a pair of frame members 12. The stacker means 30 is provided with a metallic casing 50 made of ferrous plate detachably mounted in the frame members 12. The casing 50 has a first chamber 13 for pusher means 15 and second chamber 14 for accumulated bills 1.

The pusher means 15 is drivingly connected with the conveyer means 20 through an intermediate gear 44 to urge a bill into the second chamber 14 as mentioned hereinafter.

The validator means 10 shown in FIG. 1 is detachably secured to the frame members 12 and is provided with an inlet 11 into which a bill is inserted. The inlet 11 is communicated with a passageway defined by a guide member 22 in the conveyer means 20 through a transporting device not shown in the validator means 10.

The validator means 10 includes optical or magnetic sensors (not shown) for detecting physical features from the bill passing along the guide member 22 to identify the authenticity or denomination of the bill similarly to a known validator structure.

Figure 2:
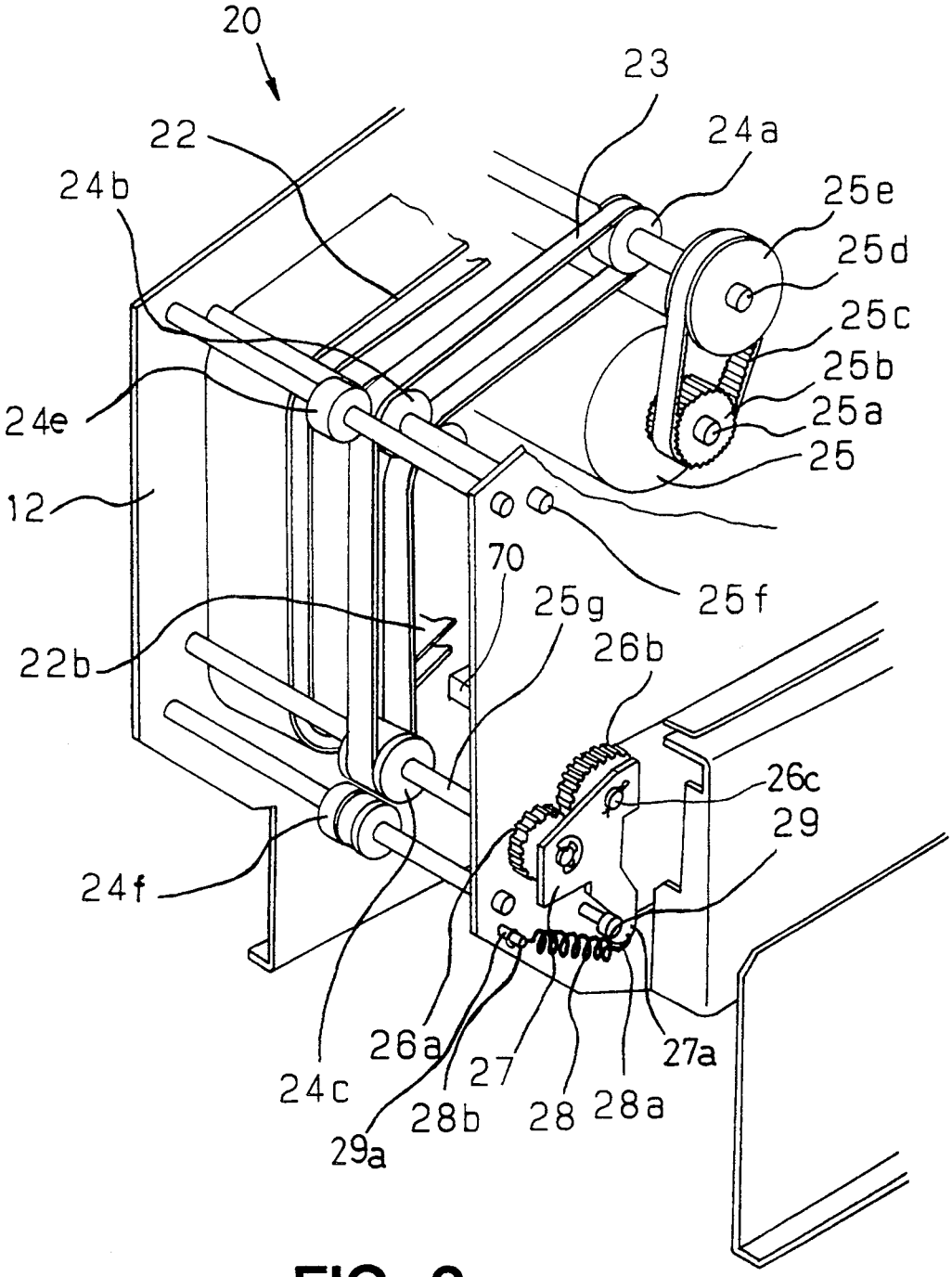

As illustrated in FIGS. 1 and 2, the guide member 22 of the conveyer means 20 has an inlet end **22*a* to receive a bill supplied from the validator means 10. An outlet end 22*b* of the guide member 22 extends into the stacker means 30 so that a bill is smoothly conveyed from the validator means 10 through the conveyer means 20 to the stacker means 30. To this end, an endless belt 23 is supported for movement by pulleys 24*a*, 24*b*, 24*c*, 24*d* and 24*e* along the guide member 22. Accordingly, the bill which passes through the validator means 10 is conveyed by the endless belt 23 along the guide member 22 to the stacker 30. As shown by FIG. 2, secured to the frame member 12 is a motor 25 for driving the endless belt 23. The motor 25 has a motor shaft 25*a* for rotatably supporting a pinion 25*b* which is drivingly connected with a pulley 25*e* through a toothed belt 250. The pulley 25*e* is supported by a shaft 25*d* to which the pulley 24*a* is also secured to drive the endless belt 23**.

As understood from FIG. 2, the belt 23 is wound around the pulley **24*c* secured to a shaft 25*g* having one end to which a sun gear 26*a* is attached. Rotatably mounted on the end of the shaft 25*g* is a support 27 which rotatably supports a drive or planet gear 26*b* meshed with the sun gear 26*a*. Accordingly, the planet gear 26*b* may be rotated around a pin 26*c* attached to the sup port 27 and the pin 26*c* may be rotated around the shaft 25*g*. A protrusion 27*a* of the support 27 is connected to one end of a coil spring 28 whose other end is engaged with a pin 29*a* secured to the frame member 12 so that the spring 28 urges the support 27 to rotate in the clockwise direction around the shaft 25*g*. A stopper pin 29 is provided on the frame member 12 to stop rotation of the support 27 in the clockwise direction. A photosensor 70 is attached to the frame member 12 to detect discharge of the bill 1 from the conveyer means 20**.

Figure 7:
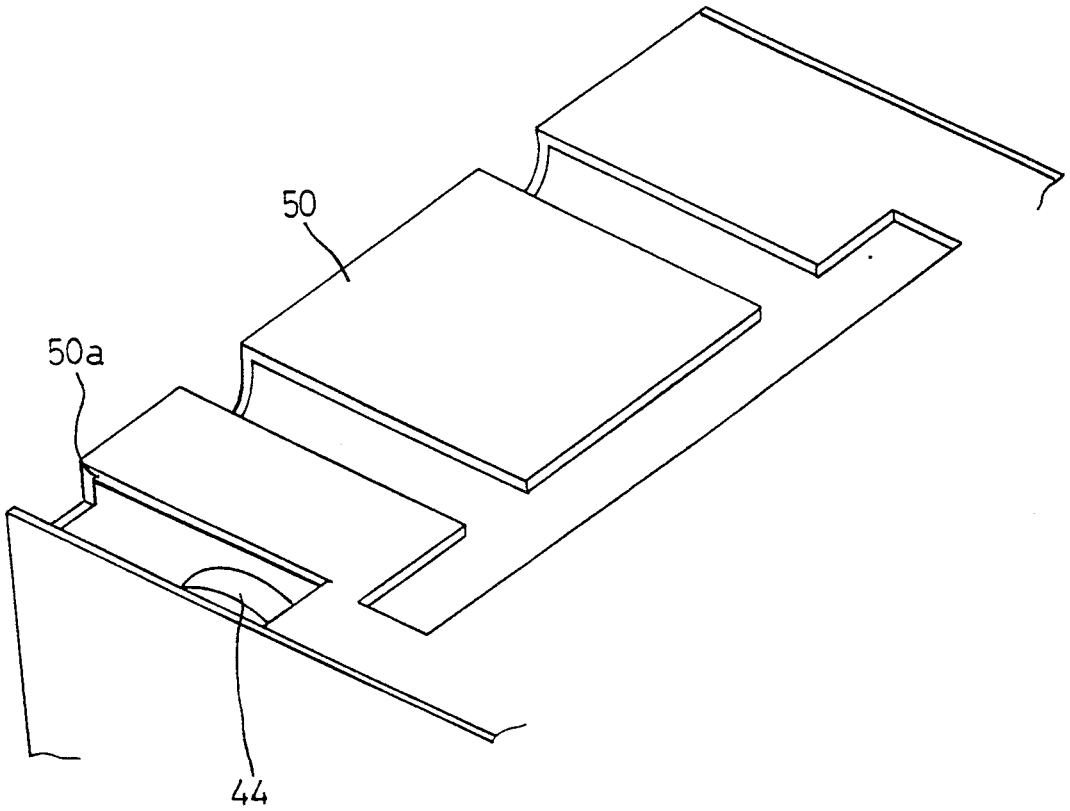

The casing 50 is formed into a rectangular shape and is provided with a pair of guide pins 53 (FIG. 4) at opposite side walls so that the guide pins 53 are moved along guide rails (not shown) formed on inner walls of the frame members 12. The intermediate gear 44 is rotatably mounted in the casing 50 of the stacker means 30 in the vicinity of an opening 50*a* of the casing 50 as shown in FIG. 7.

When the casing 50 of the stacker means 30 is inserted into the frame members 12 as shown in FIG. 1, the intermediate gear 44 is brought into engagement with the planet gear 26*b* and the spring 28 serves to absorb the impact force of the intermediate gear 44 against the planet gear 26*b*.

Figure 4:
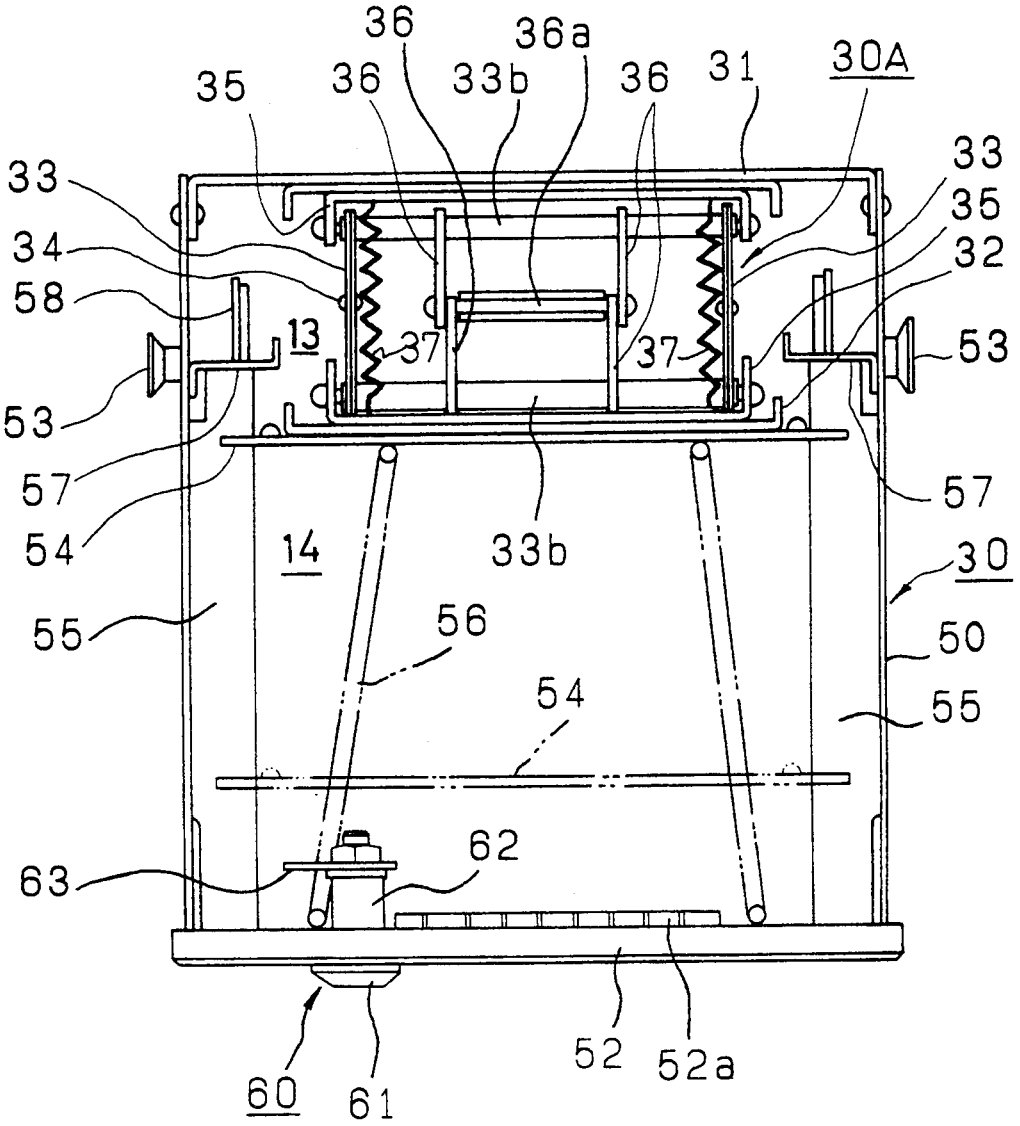
Figure 5:
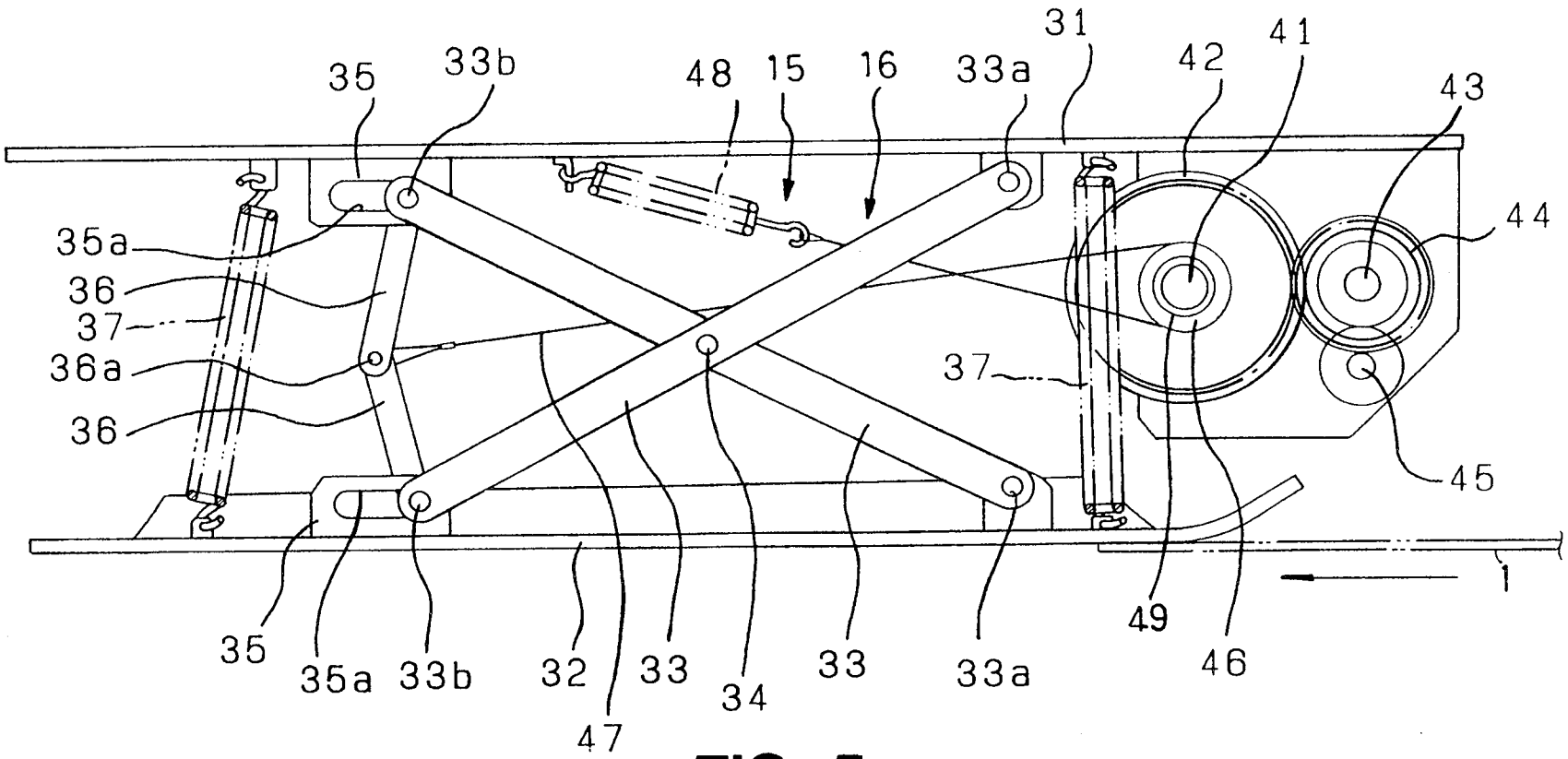

FIG. 5 illustrates the pusher means 15 of the stacker means 30 which comprises a base plate 31 which may shield an opened upper side of the casing 50 when the pusher means 15 is inserted into the first chamber 13 of the casing 50. A pusher plate 32 is connected to the base plate 31 in parallel relation by a pair of link means 16 provided symmetrically of an imaginary longitudinal central plane of the casing 50 as shown in FIG. 4 for stably traveling the pusher plate 32 toward or away from the base plate 31 in parallel relation. Each of the link means 16 comprises two guide links 33 in hinged connection by an axis 34 into X shape. One end of one of the guide links 33 is in hinged connection to the base plate 31 by a shaft 33*a* supported without longitudinal movement but for hinged movement of the link member 33. The other end of the link member 33 is hinged connection to the pusher plate 32 for rotation and longitudinal movement by a shaft 33*b* received within an elongated hole 35*a* of a bracket 35 attached to the pusher plate 32. Adversely, one end of the remaining link member 33 is hinged connection to the base plate 31 for rotation and longitudinal movement by a shaft 33*b* received within an elongated hole 35*a* of a bracket 35 attached to the base plate 31. The other end of the remaining link member 33 is in hinged connection to the pusher plate 32 by a shaft 33*a* supported without longitudinal movement but for hinged movement of the remaining link member 33.

Rotatably provided adjacent to the link means 16 is a gear 42 supported on a drive shaft 41 and meshed with the intermediate gear 44 supported on a shaft 43. A pulley 46 is also attached to the drive shaft 41 via an one way clutch means not shown. The one way clutch means is mounted within the pulley 46 to inhibit operation of the link means 16 when the motor 25 is rotated in the forward direction but to operate the link means 16 only when the motor 25 is rotated in reverse direction.

As mentioned above, the motor 25 drives the endless belt 23 and the shaft 25*g*, and therefore the intermediate gear 44 is rotated via gears 26*a* and 26*b* so that the gear 42 meshed with the intermediate gear 44 may serve to travel the pusher plate 32 away from the base plate 51.

The shafts 33*b* attached to each end of the guide links 33 are rotatably connected to each one end of a pair of pusher links 36 whose other ends are pivotally linked by a pin 36*a* to each other. Engaged with the pin 36*a* is one end of a wire 47 which is wound around the pulley 46 and has the other end hooked by one end of a spring 48 to provide the wire with suitable tensile force. The other end of the spring 48 is hooked to the base plate 31. Four tensile springs 37 are provided between the base plate 31 and pusher plate 32 to elastically urge the pusher plate 32 toward the base plate 31.

Figure 3:
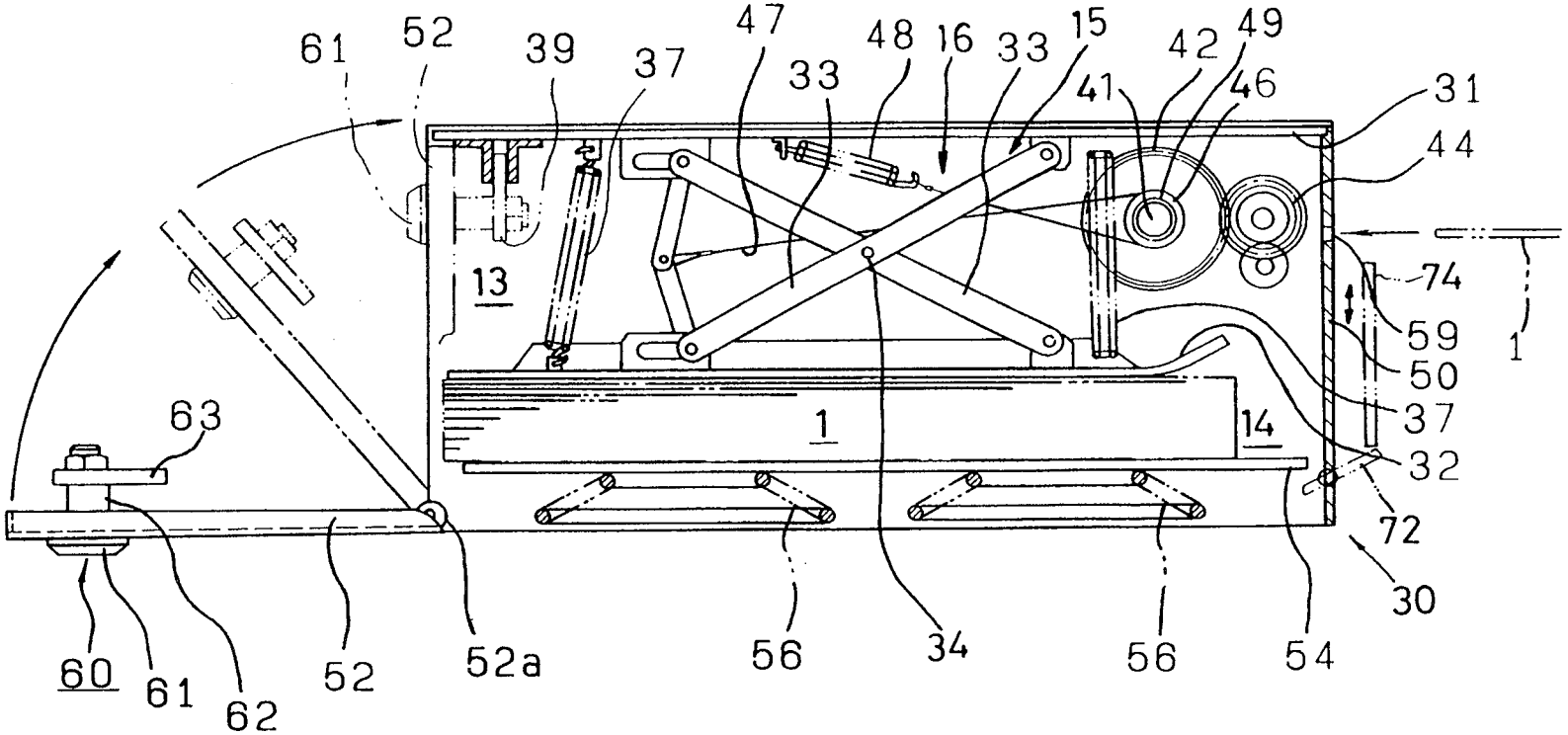

As apparent from FIG. 3, a coverage 52 is rotatably attached by a hinge pin 52*a* to the casing 50 to shield a front end of the casing 50 with lock means 61 such as a cylinder lock device. The lock means 61 may be unlocked by a proper key which may be inserted into the look means 61 and rotated together with a lever 63 from the locked position engaged with a striker 39 to the unlocked position disengaged therefrom to open the coverage 52. Adverse rotation of the key may look the lock means 61.

Figure 6:
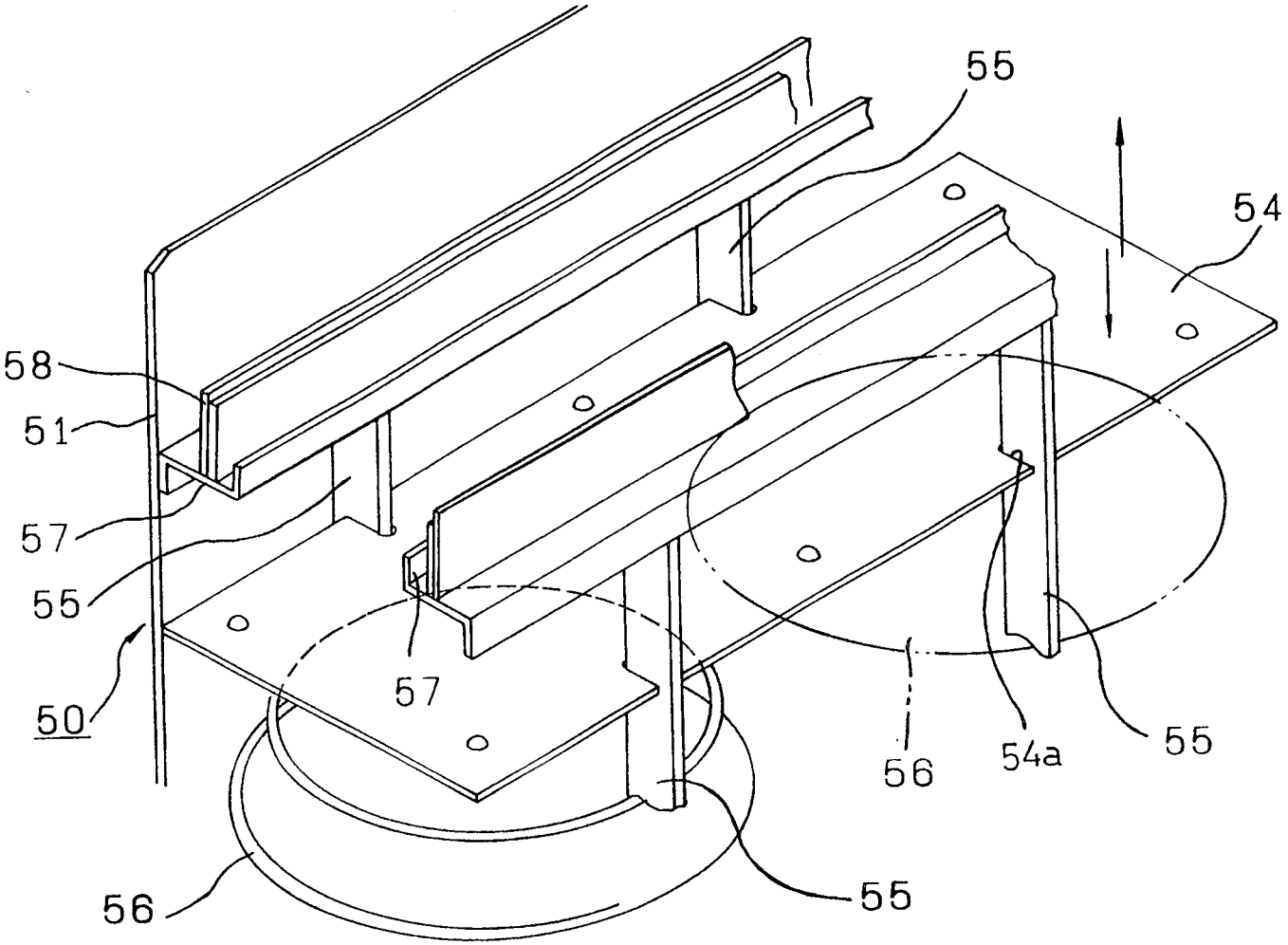

Formed at a back wall of the casing 50 is a slit 59 for receiving a bill 1 supplied from the conveyer means 20. A back plate 54 is positioned within the second chamber 14 of the casing 50 so that it is resiliently urged toward stoppers 57 by springs 56 positioned between a bottom wall of the casing 50 and back plate 54. When no bill is positioned within the second chamber 14, the back plate 54 is brought into contact with the stoppers 57 fixed to the casing shown in FIG. 4 by means of elastic force of the springs 56. A width of a gap defined between the stoppers 53 is designed such that the pusher plate 32 may pass through the gap in order to travel the bill from the first chamber 13 to the second chamber 14. The back plate 54 and springs 56 serve to hold accumulated bills between the back plate 54 and stoppers 57 in the second chamber 14. As shown in FIG. 6, vertical movement of the back plate 54 is guided by guide members 55 which are engaged with notches 54*a* formed in the back plate 54.

An assembly, the casing 50 of the stacker means 30 is inserted between the frame members 12 so that the intermediate gear 44 is automatically brought into engagement with the planet gear 26*b* for driving connection of the pusher means 15 by the single motor 25. In disassembly, the casing 50 may simply removed from the frame members 12 in disengagement of the intermediate gear 44 from the planet gear 26*b*.

In use, a bill 1 is inserted into the inlet 11 and is detected by photoelectric sensors within the validator 10 so that the transporting device of the validator means 10 is driven to travel the bill to the conveyer means 20 when a central processing unit not shown of the validator means 10 detects identification of authenticity of a genuine bill. If the validator means 10 can not detect identification of the authentication of a genuine bill, the transporting device is driven in the reverse direction and the inserted bill is returned to the inlet 11.

Upon detection of identification of authenticity of a genuine bill, the central processing unit also produces an output to start driving of the motor 25 in the forward direction. Therefore, the bill forwarded from the validator means 10 is then transported by the conveyer means 20 along the guide member 22 to the stacker means 30. In this case, the link means 16 is not operated by the one way clutch means of the pulley 46. When the bill 1 is supplied from the conveyer means 20 to the first chamber 13 of the stacker means 30, it is detected by the photosensor 70. Accordingly, when a predetermined period of time has elapsed after the photosensor 70 produces an output representative of detection of the bill 1, the central processing unit produces a commend signal to rotate the motor 25 in the adverse direction. Then, the pulley 46 is rotated by the motor 25 through gears 26*a*, 26*b*, 44 so that the wire 47 is wound around the pulley 46 and pulls the pin 36*a* toward the pulley 46. The pusher links 36 are expanded to travel the pusher plate 32 away from the base plate 31 against the resilient force of the tensile springs 37, thereby the bill 1 on the stoppers 57 is pushed into the second chamber 14 from the first chamber 13, overriding the stoppers 57. Thus, the bill 1 is urged onto the back plate 54 against the resilient force of the springs 56 to the extended position. When the bill 1 is moved to a fully pushed position within the second chamber 14, then the central processing unit ceases to produce the driving signals for the motor 25. The friction force of the driving system including the gears 42 and 44 prevents rotation of the gear 42 and drive shaft 41 in the forward direction, when the motor 25 is stopped, and therefore the pusher links 36 is kept in the expanded condition until the motor 25 is rotated in the forward direction. If a next bill is inserted into the inlet 11 and is detected as a genuine bill by the central processing unit, the motor 25 is rotated in the forward direction to transport the bill from the conveyer means 20 to the stacker means 30. For that reason, resilient force of the springs 37 causes to move the pusher plate 32 from the extended position to the retracted position.

In this embodiment, when the bill contained within the second chamber 14 is tried without authorization to be pulled out of the stacker means 30 by such as a string material, it would be impossible without complete destruction of the apparatus to succeed such extraction of the bill, since the pusher plate 32 covers and holds the bill under the expanded condition of the link means 16.

When a full amount of the bills 1 is stacked within the casing 50, a proper key is inserted into the lock means 61 and rotated together with a lever 63 from the locked to the unlocked position so that the coverage 52 may be opened. Due to the locked coverage 52, unauthorized extraction of any bill from the casing 50 is completely prevented.

When the stacker 30 is released from the frame members 12, the intermediate gear 44 of the casing 30 is free from the planet gear **26*b* and therefore, the pusher plate 32 can be moved from the extended position to the retracted position by resilient force of the spring 37**.

As mentioned above, the stacker according to the present invention is effective to completely hinders withdrawal of the bill by the pusher plate because the link means firmly retain the pusher plate in the extended position due to friction force of the driving system when the bill is drawn back from the stacker by pulling the string material. Also, the lock means effectively prevents unauthorized opening of the coverage of the casing.

What is claimed is:

1. A currency stacker for accumulating bills supplied thereto through conveyer means from validator means, said currency stacker comprising:

a metallic casing including first and second chambers and a slit through which a bill is supplied to the first chamber;

pusher means positioned within the first chamber of said casing for pushing a bill in said first chamber into said second chamber, said pusher means comprising a base plate, a pusher plate and link means connecting said base plate and pusher plate for traveling said pusher plate from a retracted position within said first chamber to an extended position in the second chamber toward and away from said base plate to push the bill into the second chamber by movement of said pusher plate from the retracted position to the extended position;

driving means disposed within said first chamber for operating said link means to travel said pusher plate between the retracted and extended position;

said driving means being disengageably in driving connection with a motor provided in said conveyer means for receiving driving force; and said driving means retaining the pusher plate of said pusher means in the extended position to prevent movement of the bill from the second chamber to the first chamber except when the bill is supplied through said slit into said first chamber.

2. The currency stacker of claim 1, wherein said driving means further comprises an intermediate gear which is disengageably meshed with a planet gear driven by the motor in the conveyer means.

3. The currency stacker of claim 2, wherein said planet gear is rotatably mounted on a support for engagement with a sun gear driven by said motor, said support being rotatably mounted on said conveyer means.

4. A currency stacker for accumulating bills supplied thereto through conveyer means from validator means, said currency stacker comprising:

a metallic casing including first and second chambers and a slit through which a bill is supplied to the first chamber;

pusher means positioned within the first chamber of said casing for pushing a bill in said first chamber into said second chamber, said pusher means comprising a base plate, a pusher plate and link means connecting said base plate and pusher plate for traveling said pusher plate from a retracted position within said first chamber to an extended position in the second chamber toward and away from said base plate to push the bill into the second chamber by movement of said pusher plate from the retracted position to the extended position; and driving means disposed within said first chamber for operating said link means to travel said pusher plate between the retracted and extended positions;

wherein said driving means comprises:

a drive shaft supported by said casing;

a pulley rotatably mounted on the drive shaft;

a wire wound around the pulley and connected between said casing and said link means;

a gear mounted on said drive shaft for transmitting the driving force from said conveyer means to said drive shaft; and a spring for resiliently urging said pusher plate, thereby said pulley pulling said link means via said wire against elastic force of said spring to cause said pusher plate to move to the extended position upon rotation of said drive shaft, said driving means retaining the pusher plate of said pusher means in the extended position to prevent movement of the bill from the second chamber to the first chamber except when the bill is supplied through said slit into said first chamber.

5. The currency stacker of claim 4, wherein said driving means further comprises an intermediate gear which is disengageably meshed with a planet gear driven by a motor in the conveyer means.

6. The currency stacker of claim 5, wherein said planet gear is rotatably mounted on a support for engagement with a sun gear driven by said motor, said support being rotatably mounted on said conveyer means.

7. The currency stacker of claim 5, wherein said pulley has a one way clutch to drivingly connect said gear and pulley in only one rotational direction.

8. The currency stacker of claim 6, wherein said pusher plate is moved from the extended position to the retracted position by elastic force of said spring when said one way clutch releases driving force of said motor rotated in the forward direction.

* * * * *